United States Patent [19]

Routh et al.

[11] 3,996,771

[45] Dec. 14, 1976

[54] METHOD FOR KNITTING AND HEAT-SETTING CIRCULAR KNIT ARTICLES

[76] Inventors: Herman M. Routh, 365 Bossong Drive; Otis H. Allen, Sr., Halifax St., both of Asheboro, N.C. 27703

[22] Filed: Sept. 17, 1975

[21] Appl. No.: 614,107

Related U.S. Application Data

[62] Division of Ser. No. 396,017, Sept. 10, 1973, Pat. No. 3,906,750.

[52] U.S. Cl. ..... 66/147

[51] Int. Cl.[2] ..... D04B 1/26; D04B 9/46; D04B 15/92; D04B 35/00

[58] Field of Search ..... 66/147, 149 S; 28/74 H; 68/5 C; 223/76

[56] References Cited

UNITED STATES PATENTS

| | | | |
|---|---|---|---|
| 3,333,441 | 8/1967 | Soussloff et al. | 66/147 |
| 3,686,726 | 8/1972 | Glaze, Jr. et al. | 28/74 H |

FOREIGN PATENTS OR APPLICATIONS

| | | | |
|---|---|---|---|
| 1,453,387 | 8/1966 | France | 66/147 |

OTHER PUBLICATIONS

Strasser, F., *Some Conventional and Unconventional Methods and Processes in Double-Jersey Production of the Future*, Textile Institute and Industry, 8(12): pp. 337–340, Dec. 1970.

*Primary Examiner*—Robert R. Mackey

[57] ABSTRACT

A method for heat setting the stitches of a circular knit fabric article immediately upon discharge of the fabric article from the knitting instrumentalities includes mechanisms, controlled from the knitting machine, for directing and conveying the fabric article to a heat chamber, introducing water into the heat chamber which is volatized to heat set the stitches, removing the heat set fabric article from the heat chamber, and directing the fabric article to a receptacle.

3 Claims, 6 Drawing Figures

METHOD FOR KNITTING AND HEAT-SETTING CIRCULAR KNIT ARTICLES

This is a divisional application of copending application Ser. No. 396,017 filed on Sept. 10, 1973, now U.S. Pat. No. 3,906,750 issued on Sept. 23, 1975.

BRIEF SUMMARY AND OBJECTS OF THE INVENTION

This invention relates generally to the heat setting of stitches of knit fabric formed at least partially of synthetic fibers, and more particularly to the heat setting of the stitches by means provided proximate a circular knitting machine and controlled thereby.

While the various types of knit fabric sections or garments may be heat set by the apparatus, the invention is primarily concerned with heat setting the stitches of hosiery immediately upon the garment being discharged from the knitting instrumentalities of a circular knitting machine.

The mechanism includes a conduit arrangement for directing the knit fabric from the knitting machine to a chamber and from the chamber to a receptacle or other suitable means. Doors are provided at each end of the chamber for permitting fabric to be introduced into and removed from the chamber. Within the chamber, the fabric is maintained in spaced relation to a heating unit, and upon injection of a prescribed amount of water onto a heated surface within the chamber, the water volatizes thereby exposing the fabric to steam and setting the stitches. The various components for directing the fabric through the conduit arrangement, the chamber doors, the injection of water, etc., are controlled from the knitting machine to perform their respective functions in a required, timed relation.

One of the primary objects of the invention is the provision of a new and improved system for heat setting the stitches of a knit fabric.

Another object of the invention is the provision of a new process and apparatus for subjecting knit fabric to a steam treatment immediately upon discharge from the knitting instrumentalities of a circular knitting machine.

A further object of the invention is to enable the stitches of a knit fabric or garment to be heat set conveniently and satisfactorily by an apparatus controlled from the knitting machine.

Still another object of the invention is the provision of a system for heat setting knit fabric stitches automatically at the knitting machines rapidly and economically.

Other objects and advantages of the invention will become apparent when considered in view of the following detailed description of the invention.

DETAILED DESCRIPTON OF THE INVENTION

Figure 1:
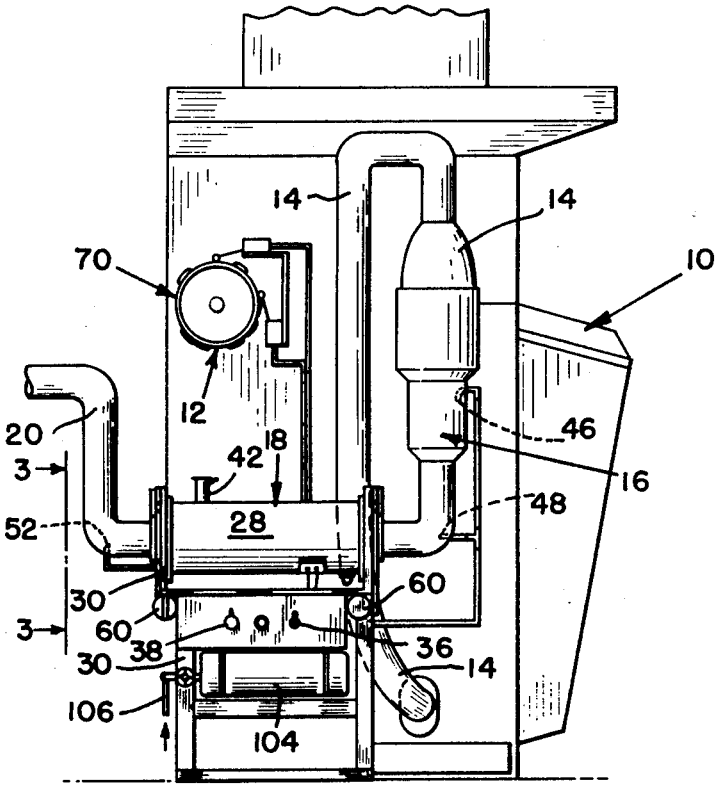
FIG. 1 is a schematic elevational view of a knitting machine having the fabric stitch setting mechanism positioned at one side thereof.

Referring to the drawing, and particularly to FIG. 1, the machine 10 is a conventional circular knitting machine having a pattern drum 12. Sections of fabric or garments, which may be in the form of hosiery, and sequentially discharged in a conventional manner by the knitting machine, are transferred by an air blast through a tube or funnel 14. Preferably the air blast is in timed sequence with the discharge of the fabric section from the knitting machine.

Figure 2:
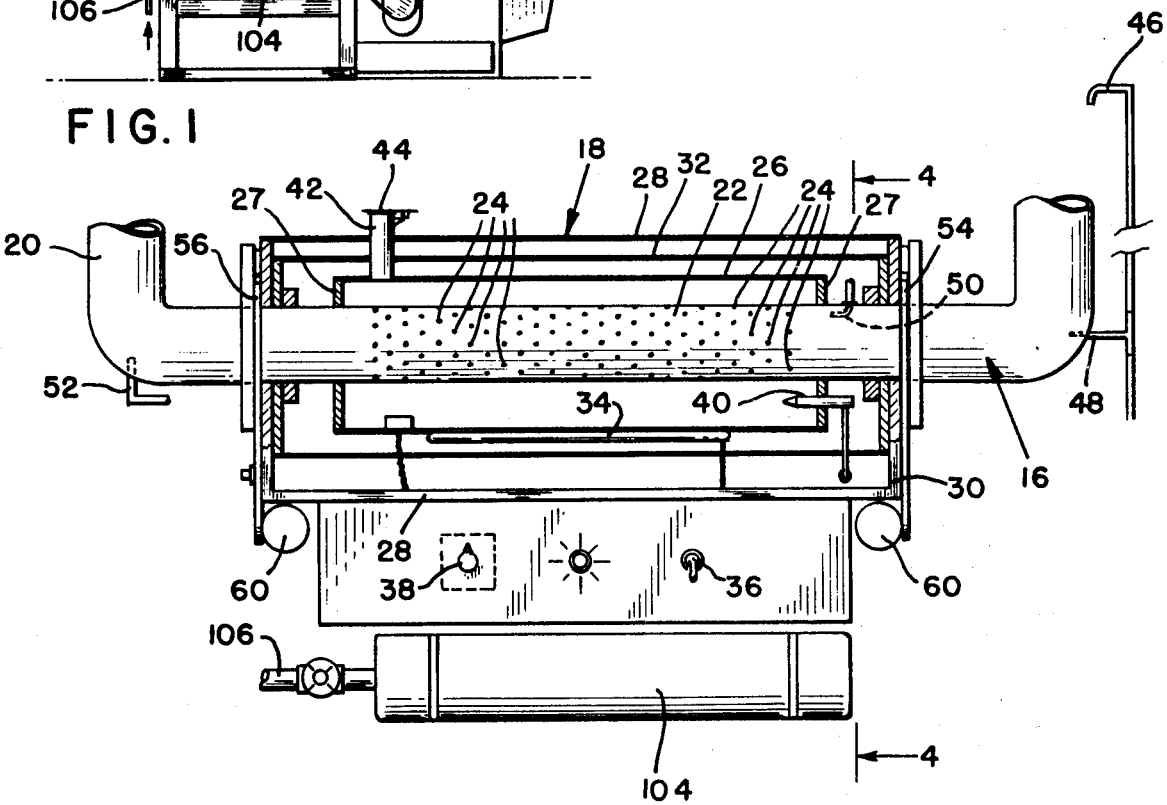
FIG. 2 is an enlarged, fragmentary, side elevational view, partly in section, of the apparatus illustrating the heat chamber, controls and conduit for directing the fabric to and from the chamber.

The fabric section is directed immediately from the machine 10, through conduit or tube 14, tube assembly 16, and into a heat assembly 18 for a prescribed time period where the stitches are set. Subsequently, the heat set fabric is discharged from the heat assembly 18 and transferred through conduit 20 to a container or other suitable receiving means, not shown. The heating assembly 18 comprises a glass-lined brass tube 22, FIGS. 2 and 4, which interconnects the conduits 16 and 20 and serves to support a knitted fabric section within the heating assembly and also serves to guide the fabric from the inlet conduit 16 to the outlet conduit 20. In one embodiment, the inner and outer diameters of the tube 22 substantially correspond to those of the conduits 16 and 20 and the tube may be approximately 13 inches long. The tube 22 is provided with a plurality of small openings 24, as shown by FIG. 2, around the circumference and throughout a substantial portion of the tube length. The function of the openings 24 will be described subsequently.

Encompassing the tube 22 in spaced relation thereto is a tube 26, preferably of aluminum. The ends of the tube 26 are closed by end members 27 which may be of Teflon or other suitable material. The tubes 22 and 26 are enclosed within a housing 28 which is supported by a frame 30 adjacent the knitting machine 10. An additonal tubular member 32, FIG. 2, may be provided intermediate the housing 28 and the aluminum tube 26.

Figure 4:
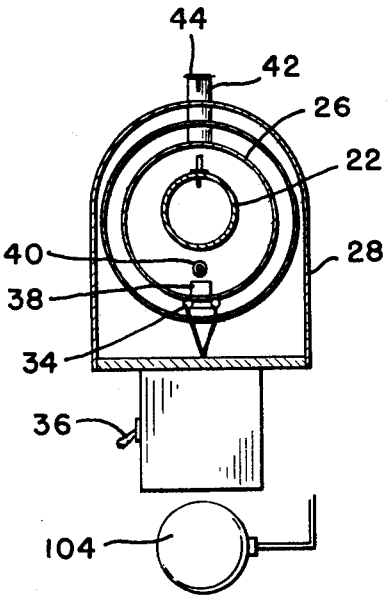
FIG. 4 is a view taken along line 4—4 of FIG. 2.

A heating unit 34 is mounted adjacent to and outwardly of the aluminum tube 26, as shown most clearly by FIGS. 2 and 4. The heater 34 may be of the type SE-1205 manufactured by Chromolox. The heating unit is actuated by a switch 36 and the temperature is controlled by a thermostat 38 such that the temperature within the aluminum tube 26 is normally at a selected temperature within the range of 190° F. 250° F., although the range could be varied, if desired.

A water jet 40 extends through one of the end members 27 into tube 26 for directing water upon the inner surface of the tube 26 which is heated to a selected temperature by the heating unit 34. The water is volatized and the steam or vapor passes upwardly through the openings 24 in the glass-lined tube 22. Excess steam or vapor passes from the tube 26 to the atmosphere through a small conduit 42. The conduit outer end is provided with a cap 44 which is normally closed. However, the cap 44 may be at least partially pivoted to an open position by the steam to permit excess steam to escape.

To control the displacement of a knit garment or fabric section by air flow, air jets 46 and 48 have been provided in the tube assembly 16, a jet 50 provided within the inner tube 22, and a jet 52 provided within the exit tube 20. It is to be understood that vacuum, rather than an air blast, may be used if desired.

Figure 3:
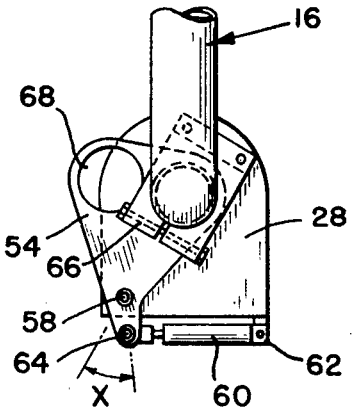
FIG. 3 is an end elevational view of the heat chamber illustrating one closure assembly for controlling fabric to or from the heat chamber.

Doors 54 and 56 are provided at the ends of the housing 28 for permitting knitted fabric to enter or exit the heating assembly 18. As shown most clearly by FIG. 3, each door is pivotably mounted upon a pin 58 and is selectively positioned by means of a fluid cylinder 60 which has one end 62 supported by the frame 30 and the opposite end pivotably connected, as shown at 64, to a door 54 or 56. The doors are displaceable in planes transversely of the heating assembly 18 and in spaces provided intermediate the ends of inner tube 22 and the tubes 16 and 20. The ends of the tubes 16, 20 adjacent the housing 28 may be supported by clamping assemblies 66 secured to the housing 28 or frame 30. Each door is generally triangular shaped and defines an opening 68, FIG. 3, having an inner diameter which substantially corresponds to the inner diameter of the tube 22 and the tubes 16, 20. As shown by FIG. 3, a solid portion of the door 54 is intermediate the tube 22 and tube assembly 16 thereby preventing knitted fabric from entering the heating assembly 18. Upon actuation of the door 54, by the cylinder 60, to displace the door through the arc X, the opening 68 is aligned with the open ends of the tubes 16 and 22 thereby permitting access to the chamber of the heating assembly 18.

The door 56 is substantially identical to door 54 and may be actuated to permit removal of knitted fabric from the tube 22 of the heating assembly 18.

Figure 5:
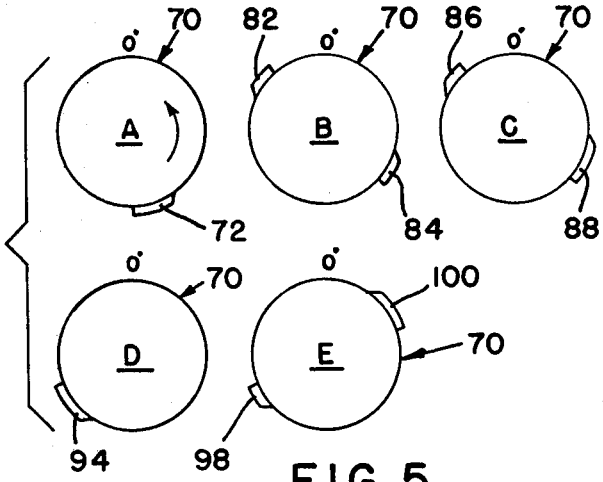
FIG. 5 is a schematic view illustrating the positioning of the various control cams relative to each other, the cams being mounted upon the knitting machine pattern drum.

The flow of air through the jets 46,48,50,52, the injection of water into the tube 26 through the jet 40, and the opening and closing of the doors 54, 56, are controlled in a prescribed sequence by the operation of the knitting machine 10. While the various components may be controlled by various means such as cams, chains, etc., in the embodiment illustrated the components are controlled by cams selectively positioned upon an extension 70 of a pattern drum 12. FIG. 5 illustrates schematically five sections A, B, C, D, E of the drum extension 70, each having at least one cam thereon and with the cams being selectively positioned circumferentially relative to each other.

Figure 6:
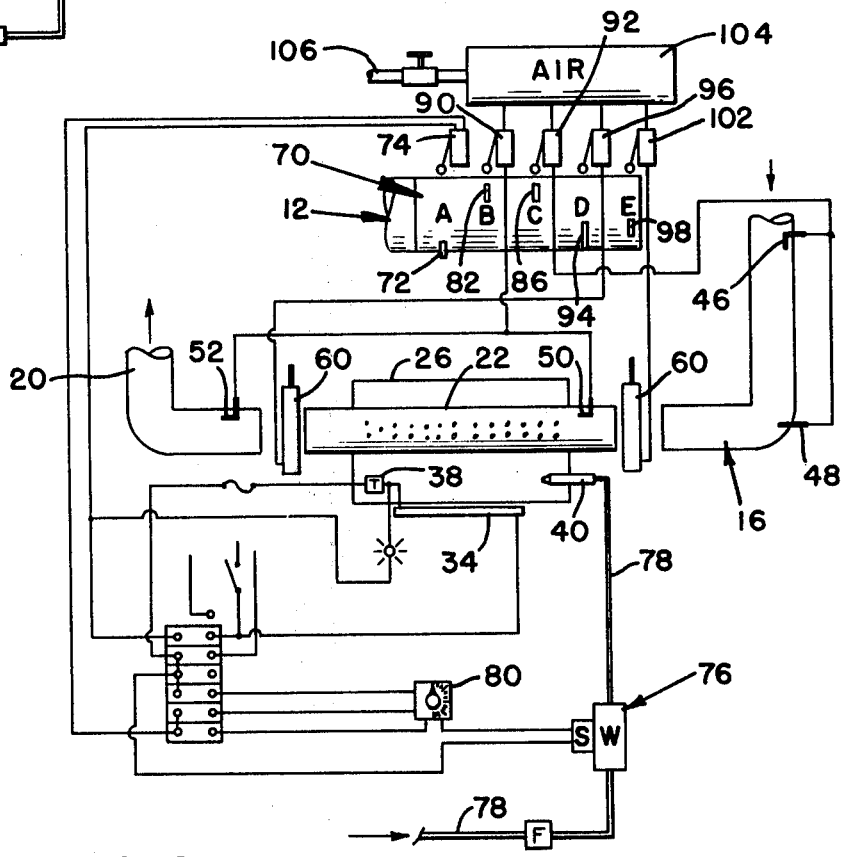
FIG. 6 is a schematic diagram of the electrical system, the air system, and the water system of the invention illustrating the various controls for the apparatus.

Referring to FIGS. 5 and 6, the first section A has a single cam 72. Cam 72, upon movement passed switch 74 actuates the switch to control a solenoid valve 76 for injecting water into the tube 26 through the jet 40. The water is directed to the jet 40 from a source, not shown, through line 78, a filter F, and the solenoid valve 76. A timer 80 may be provided to control the solenoid 76 and determine the amount of water injected into the tube 26.

The second section B and the third section C are provided for two cams each, cams 82 and 84 on section B and cams 86 and 88 on section C. The cams control air valves 90, 92 for directing air to jets 52 within the exhaust tube 20, to jet 50 within the glass-lined brass tube and to jets 46 and 48 on the entrance tube assembly 16. Additional air valves and jets could be added, if desired.

The fourth section D is provided with a single cam 94 which actuates air valve 96 which, in turn, controls the air cylinder for displacing the door 56 to the open position thereby permitting a knitted fabric within the tube 22 to be ejected therefrom and through exhaust tube 20 by an air flow.

The fifth section E is provided with two cams 98, 100, as shown by FIG. 5, for controlling the operation of the entrance door or plate 54 by means of the fluid cylinder 60. The door cylinder 60 is controlled from an air valve 102.

The various air valves 90, 92, 96, and 102 receive air from a tank 104 which is connected to a source, not shown, by a line 106.

In the operation of the system, and prior to the completion of the garment or fabric being knit on the machine 10, the cam 100 actuates air valve 102 which, through a cylinder 60, opens the front door 54 to permit access to the inner, glasslined, brass tube. At this time the door 56 remains closed. Both of the doors 54 and 56 are urged to the closed position automatically by means of gravity, springs, etc. Upon discharge of the garment or other knit fabric from the knitting machine and through tube 14 in a conventional manner, cams 84 and 88 actuate substantially simultaneously valves 90 and 92, respectively, for directing the knit fabric by air pressure, through conduit assembly 16 and to the glass-lined brass tube 22. The fabric is retained in the tube 22 since exit door 56 is closed. It is to be understood that a vacuum, rather than an air blast, may be used for displacing the knitted fabric within the tubes. Upon rotational displacement of the cam 100 past the air valve 102, the front door 54 automatically closes.

Upon continued rotation of the pattern drum extension 70, the cam 72 actuates switch 74 and valve 76 to permit water to be injected through jet 40 onto the inner surfaces of the aluminum tube 26 which have been heated by the unit 34. The water is volatized and the steam passes through openings 24 in the tube 22 which holds the knit fabric to heat set the stitches of the fabric. The amount of water injected into the tube 26 may be controlled by timer 80. In the knitting of hosiery, for example, approximately ten seconds of steam in the tube 22 is sufficient to heat set the stitches.

Immediately after discharge of the knit fabric from the machine, the knitting of a second section of fabric is initiated. Prior to completion of the second knit garment or section, the front and rear doors 54 and 56 to the inner tube 22 are opened by the cams 98 and 94 which control fluid cylinders 60, 60. Therefore, upon further rotation of drum extension 70, cams 82 and 86 actuate switches 90 and 92, respectively, to direct air through nozzles 46, 48, 50 and 52 to remove the heat set knit fabric from the tube 22, through conduit 20 into a receptacle, not shown. Upon disengagement of the followers of the valves 90 and 92 from the cams 82 and 86, the air blast ceases and the doors 54 and 56 close automatically. Another cycle is initiated prior to completing the knitting of the second garment or fabric section.

We claim:

1. The method of automatically treating knit fabric articles immediately upon discharge from a circular knitting machine to heat set the stitches thereof comprising the steps of, continuously knitting a plurality of fabric articles in succession on a circular knitting machine, discharging each knit fabric article from the machine knitting instrumentalities, conveying each knit fabric article in succession to a prescribed location through the front door of a heat assembly, having both front and rear doors, immediately upon discharge from the knitting instrumentalities of a knitting machine, closing said front door of a said heat assembly, heat setting the stitches of the knit fabric article, opening said front and rear doors of said heat assembly, and conveying the heat set article knit fabric through the back door of said heat assembly to a prescribed location.

2. The method of treating knit fabric articles as recited in claim 1, wherein the stitches of the knit fabric article are subjected to steam to set the stitches.

3. The method of treating knit fabric articles immediately upon discharge from a circular knitting machine as recited in claim 1, wherein the knit fabric article is conveyed to a prescribed location by fluid means.

* * * * *